US010766722B2

(12) United States Patent
Imamiya et al.

(10) Patent No.: US 10,766,722 B2
(45) Date of Patent: Sep. 8, 2020

(54) IMAGE FORMING APPARATUS AND SHEET CONVEYANCE METHOD

(71) Applicant: TOSHIBA TEC KABUSHIKI KAISHA, Shinagawa-ku, Tokyo (JP)

(72) Inventors: Koji Imamiya, Kawasaki Kanagawa (JP); Katsutoshi Mita, Misato Saitama (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/257,087

(22) Filed: Jan. 25, 2019

(65) Prior Publication Data

US 2020/0239262 A1 Jul. 30, 2020

(51) Int. Cl.

| | |
|---|---|
| ***B65H 3/44*** | (2006.01) |
| ***G03G 15/00*** | (2006.01) |
| ***B65H 33/04*** | (2006.01) |

(52) U.S. Cl.

CPC ..... *B65H 3/44* (2013.01); *B65H 33/04* (2013.01); *G03G 15/655* (2013.01); *G03G 2215/00894* (2013.01)

(58) Field of Classification Search

CPC ..... B65H 3/44; B65H 33/04; G03G 15/655; G03G 2215/00894

See application file for complete search history.

(56) References Cited

U.S. PATENT DOCUMENTS

| | | | | |
|---|---|---|---|---|
| 6,227,531 | B1 * | 5/2001 | Guerrero | B65H 33/04 270/1.01 |
| 2013/0003124 | A1 * | 1/2013 | Yamazaki | G03G 15/655 358/1.15 |
| 2018/0120732 | A1 * | 5/2018 | Imamiya | G03G 15/0849 |

FOREIGN PATENT DOCUMENTS

| | | |
|---|---|---|
| JP | 2013-237205 | 11/2013 |

* cited by examiner

*Primary Examiner* — David H Bollinger

(74) *Attorney, Agent, or Firm* — Amin, Turocy & Watson, LLP

(57) ABSTRACT

In accordance with an embodiment, an image forming apparatus comprises a first cassette configured to accommodate a first sheet; a second cassette configured to accommodate a second sheet different from the first sheet in at least one of a size and an orientation; a controller configured to perform control to feed the first sheet to a conveyance path from the first cassette and feed the second sheet to the conveyance path from the second cassette to insert the second sheet between respective copies if a printing instruction for a plurality of copies is issued; and a sheet discharge section configured to stack the first sheet and the second sheet.

18 Claims, 7 Drawing Sheets

IMAGE FORMING APPARATUS AND SHEET CONVEYANCE METHOD

FIELD

Embodiments described herein relate generally to an image forming apparatus and a sheet conveyance method.

BACKGROUND

In a conventional image forming apparatus, a toner image can be fixed at a low temperature and a heating roller included in a fixing device is thin while a warm-up time is shortened and a power consumption is reduced. A toner having a glass transition temperature TG of 50 degrees centigrade or less is used to form the toner image that can be fixed at a low temperature. In such an image forming apparatus, a temperature at which high temperature offset of the toner occurs is low, and heat conduction in an axial direction of the heating roller deteriorates. Therefore, if sheets are continuously longitudinally fed, a temperature of a portion where no sheet passes at both ends of the heating roller rises, thereby facilitating occurrence of an overheated state. If the toner image is fixed in such a state, the high temperature offset may occur in the portion where no sheet passes, resulting in a fixing failure. There is a problem that the high temperature offset in the portion where no sheet passes conspicuously easily occurs when the toner capable of being fixed at a low temperature is used; however, the high temperature offset also occurs when other toners are used.

DETAILED DESCRIPTION

In accordance with an embodiment, an image forming apparatus comprises a first cassette configured to accommodate a first sheet; a second cassette configured to accommodate a second sheet different from the first sheet in at least one of a size and an orientation; a controller configured to perform control to feed the first sheet to a conveyance path from the first cassette and feed the second sheet to the conveyance path from the second cassette to insert the second sheet between respective copies if a printing instruction for a plurality of copies is issued; and a sheet discharge section configured to stack the first sheet and the second sheet.

Hereinafter, an image forming apparatus and a sheet conveyance method of several embodiments are described with reference to the accompanying drawings.

First Embodiment

Figure 1:
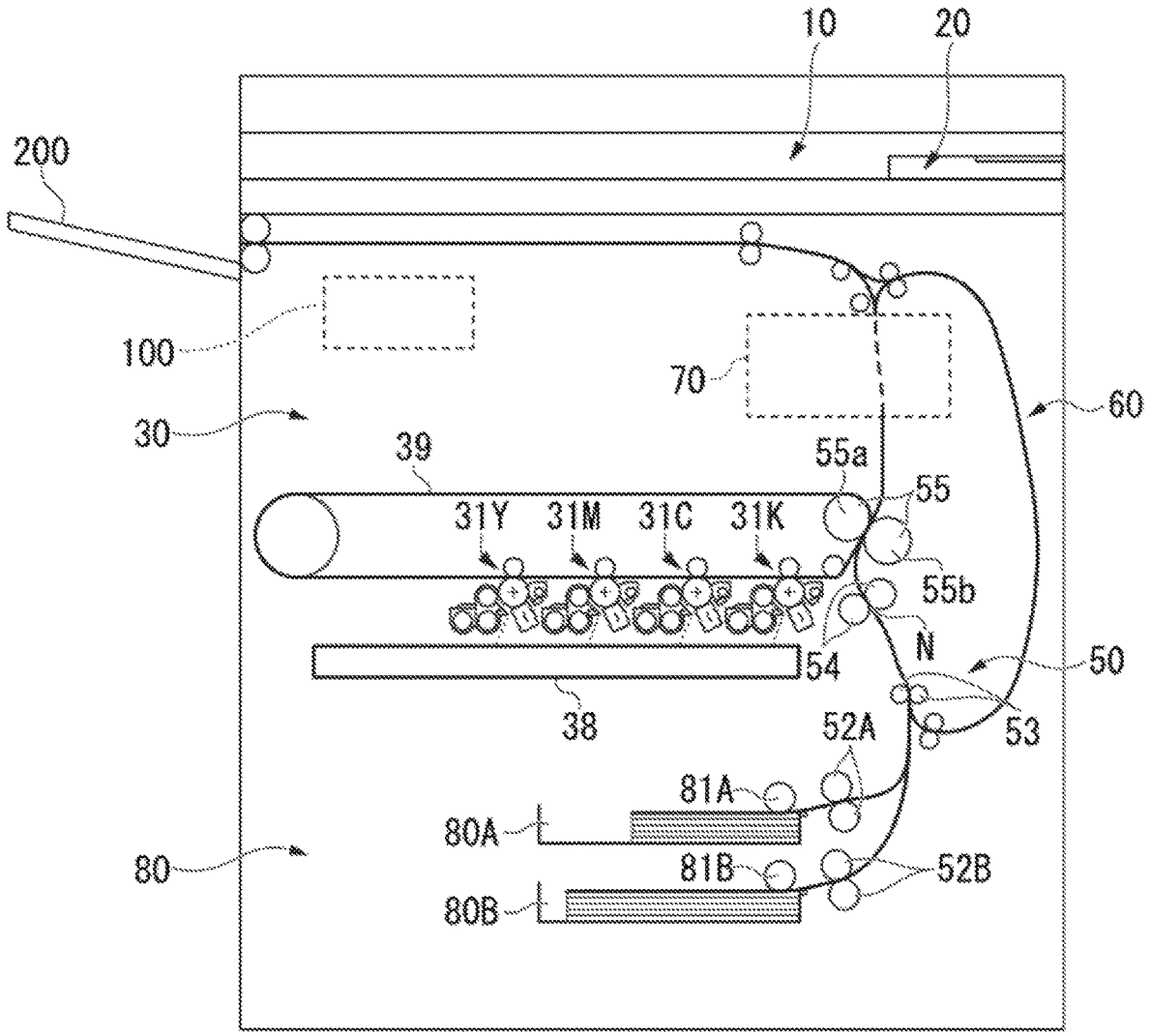
FIG. 1 is a diagram illustrating an example of an overall configuration of an image forming apparatus according to a first embodiment.

FIG. 1 is a diagram illustrating an example of an overall configuration of an image forming apparatus 1 according to the first embodiment.

The image forming apparatus 1 in the first embodiment is a multifunction peripheral (MFP). The image forming apparatus 1 performs an image forming processing for forming an image on a sheet. The sheet is, for example, a document, a paper on which characters, images, etc. are recorded or the like. The sheet may be any medium as long as it can be read by the image forming apparatus 1. The image forming apparatus 1 reads an image on a sheet and generates digital data to generate an image file.

The image forming apparatus 1 comprises an image reading section 10, a control panel 20, a printer section 30, a sheet housing section 80 and a processor 100. The printer section 30 of the image forming apparatus 1 may be a device for fixing a toner image. In the present embodiment, a case in which the printer section 30 is a device for fixing a toner image is described as an example.

The image reading section 10 reads image information of a reading object as intensity of light. The image reading section 10 records the read image information. The recorded image information may be transmitted to another information processing apparatus via a network. The recorded image information may be used to form an image on the sheet by the printer section 30.

The control panel 20 includes a display section and an operation section. The display section is a liquid crystal display, an organic EL (Electro Luminescence) display or the like. The display section displays various kinds of information relating to the image forming apparatus 1. The operation section includes a plurality of buttons. The operation section receives an operation from a user. For example, the operation section receives an input of a printing execution instruction from the user. The operation section outputs a signal corresponding to the operation performed by the user to a controller of the image forming apparatus 1. The display section and the operation section may be integrated with each other to form a touch panel.

The printer section 30 performs an image forming processing. The printer section 30 forms an image on the sheet based on the image information generated by the image reading section 10 or the image information received via a communication path. The printer section 30 in the present embodiment uses a toner which is a non-decolorable recording agent (hereinafter, referred to as "normal toner"). The normal toner is, for example, yellow (Y) toner, magenta (M) toner, cyan (C) toner, black (K) toner or the like. The normal toner, for example, may have a glass transition temperature TG of 50 degrees centigrade or lower.

The sheet housing section 80 includes a plurality of cassettes. For example, the sheet housing section 80 includes a first cassette 80A and a second cassette 80B. The first cassette 80A accommodates a first sheet. The first sheet is, for example, an A4 size sheet. The first sheet is accommodated in the first cassette 80A with a longitudinal direction thereof parallel to a sheet conveyance direction from the first cassette 80A to a conveyance path 50 (longitudinal orientation).

The second cassette 80B accommodates a second sheet different from the first sheet in at least one of a size or an orientation. The second sheet may be, for example, a sheet having the same size as the first sheet, or a sheet having a size other than the A4 size when the second sheet is different from the first sheet in the size. More preferably, the second sheet is a sheet having a size larger than A4 size (e.g., A4R size, A3 size or the like). The second sheet is accommodated in the second cassette 80B with a longitudinal direction thereof orthogonal to the sheet conveyance direction from the second cassette 80B to the conveyance path 50 (lateral orientation). The second sheet may be accommodated in the second cassette 80B in the same orientation as the first sheet.

In the first embodiment, it is assumed that the second cassette 80B accommodates the second sheet different from the first sheet in both the size and the orientation.

The first cassette 80A and the second cassette 80B are provided with pickup rollers 81A and 81B, respectively. The pickup roller 81A picks up the first sheets one by one from the first cassette 80A. The pickup roller 81A feeds the first sheet taken out from the first cassette 80A to the conveyance path 50. The pickup roller 81B picks up the second sheets one by one from the second cassette 80B. The pickup roller 81B feeds the second sheet taken out from the second cassette 80B to the conveyance path 50.

The conveyance path 50 conveys the first sheet and the second sheet in the printer section 30 and the sheet housing section 80. The conveyance path 50 includes a sheet feed roller 52A, a sheet feed roller 52B, a conveyance roller 53 and a registration roller 54.

The sheet feed roller 52A conveys the first sheet fed by the pickup roller 81A to the registration roller 54. The sheet feed roller 52B conveys the second sheet fed by the pickup roller 81B to the registration roller 54. The registration roller 54 conveys the first sheet and the second sheet to a transfer section 55 side in accordance with a timing at which the transfer section 55 of the printer section 30 transfers a toner image onto a surface of the sheet. The registration roller 54 conveys the sheet to the transfer section 55 side after aligning the tips of the first sheet and the second sheet fed by the conveyance roller 53 at a nip N.

The processor 100 controls each functional section of the image forming apparatus 1. The processor 100 is described in detail later.

Next, the detailed configuration of the printer section 30 is described. The printer section 30 includes a developing section 31, an exposure section 38, an intermediate transfer belt 39, a transfer section 55, an inversion unit 60 and a fixing device 70. In the present embodiment, the developing section 31 corresponds to a predetermined number of toners. Hereinafter, a developing section corresponding to yellow (Y) toner is described as a developing section 31Y, and a developing section corresponding to magenta (M) toner is described as a developing section 31M. A developing section corresponding to cyan (C) toner is described as a developing section 31C, and a developing section corresponding to black (K) toner is described as a developing section 31K.

Each of the developing sections 31 (31Y, 31M, 31C, 31K) supplies a developer accommodated in the developer storage section to a photoconductive drum. The developer storage section is a container to accommodate the developer. The developer is composed of carrier which is magnetic fine particle and toner of each color. When the developer is stirred, the toner is charged due to friction. As a result, the toner adheres to a surface of the carrier by an electrostatic force. A first mixer, a second mixer, a developing roller, and a temperature and humidity sensor are arranged in the developer storage section. The first mixer and the second mixer agitate the developer. The first mixer and the second mixer convey the developer. The second mixer is arranged below the developing roller. The second mixer supplies the developer accommodated in the developer storage section to the surface of the developing roller. The temperature and humidity sensor detects the temperature and humidity in the developer storage section as a state of the printer section 30.

The developing roller rotates counterclockwise by driving of a developing motor. The developing roller is constituted by a magnetic material (magnet) in which negative electrodes and positive electrodes are arranged alternately along a circumferential surface thereof. The developer supplied by the second mixer bristles in a brush shape on the surface of the developing roller in accordance with a magnetic field distribution of the developing roller. The bristling developer contacts with the surface of photoconductive drum to sweep the surface thereof as the developing roller rotates. The magnetic field distribution of the developing roller can be changed. The developing section 31 switches the magnetic field distribution of the developing roller to erect or bring down the developer. The developing roller is connected to a voltage applying circuit. The voltage applying circuit applies a voltage as a developing bias to the developing roller under the control of the processor 100. The voltage applied to the developing roller is, for example, a direct-current voltage with negative polarity.

The photoconductive drum has a photoconductive layer on its surface. The photoconductive drum rotates clockwise by the driving of the developing motor. In the periphery of the photoconductive drum, the developing section 31, a charging section, a charge removing section, a cleaning unit and a transfer roller are arranged.

The charging section uniformly charges the surface (photoconductive layer) of the photoconductive drum. For example, the charging section charges the surface of the photoconductive drum with negative polarity. As a result, a toner image is formed on the surface of the photoconductive drum according to the electrostatic latent image.

For example, the developing section 31Y develops an electrostatic latent image on the surface of the photoconductive drum using the yellow (Y) toner. The developing section 31M also develops an electrostatic latent image on the surface of the photoconductive drum using the magenta (M) toner. The developing section 31C develops the electrostatic latent image on the surface of the photoconductive drum using the cyan (C) toner. The developing section 31K develops the electrostatic latent image on the surface of the photoconductive drum using the black (K) toner.

The cleaning unit scrapes off the toner remaining on the surface of the photoconductive drum to remove it. The cleaning unit removes the toner remaining on the surface of the photoconductive drum after the toner image is transferred from the photoconductive drum onto the intermediate transfer belt 39. The toner removed by the cleaning unit is collected in a waste toner tank to be discarded.

The charge removing section faces the photoconductive drum passing through the cleaning unit. The charge removing section irradiates the surface of the photoconductive drum with light. As a result, the non-uniform charge of the photoconductive layer is made uniform. In other words, the charge of the photoconductive layer is removed.

The transfer roller faces the photoconductive drum across the intermediate transfer belt 39. The transfer roller abuts against the surface of the photoconductive drum across the intermediate transfer belt 39. The transfer roller transfers the toner image on the surface of the photoconductive drum onto the intermediate transfer belt 39 (primary transfer).

The exposure section 38 is provided at a position facing the photoconductive drums of the developing sections 31Y, 31M, 31C and 31K. The exposure section 38 irradiates the surface of the photoconductive drum of each of the developing sections 31Y, 31M, 31C and 31K with laser light. The emission of the laser light from the exposure section 38 is controlled based on image information under the control of the processor 100. The exposure section 38 emits the laser light based on image information. In this way, the negative charge on the surface of the photoconductive drum of each developing section 31Y, 31M, 31C, 31K is removed. As a result, a static electricity pattern is formed on the surface of the photoconductive drum at the position irradiated with the laser light. In other words, an electrostatic latent image is formed on the surface of the photoconductive drum by irradiation with the laser light by the exposure section 38. In the exposure section 38, LED (Light Emitting Diode) light may be used in place of the laser light.

The inversion unit 60 inverts the first sheet and the second sheet discharged from the fixing device 70 through switchback. The inversion unit 60 conveys the inverted first sheet and second sheet again to the front of the registration roller 54. The inversion unit 60 inverts the first sheet and the second sheet so as to form a toner image on a back surface of the sheet after a fixing processing.

The fixing device 70 applies heat and pressure to the first sheet. The fixing device 70 fixes the toner image transferred onto the first sheet by the heat and pressure.

Figure 2:
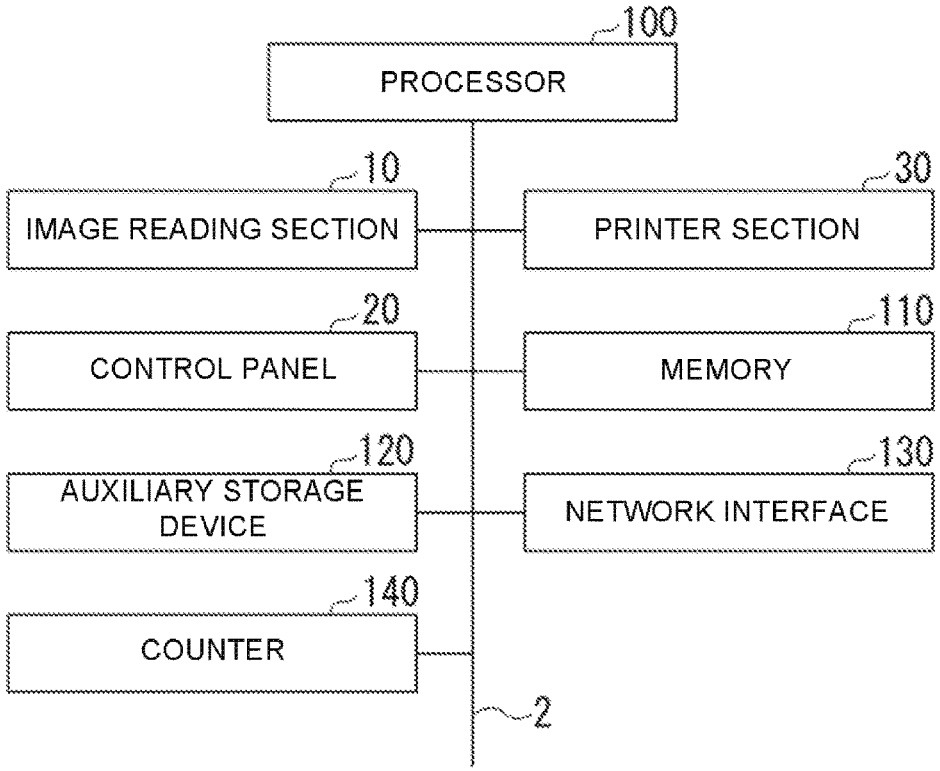
FIG. 2 is a block diagram illustrating a hardware structure of the image forming apparatus according to the first embodiment.

FIG. 2 is a block diagram illustrating a hardware structure of the image forming apparatus 1.

The image reading section 10, the control panel 20 and the printer section 30 shown in FIG. 2 are the same as those described above, and the description thereof is omitted. Below, the processor 100, a memory 110, an auxiliary storage device 120, a network interface 130, and a counter 140 are described. The respective functional sections are connected to each other so as to enable data communication via a system bus 2.

The processor 100 is, for example, a CPU (Central Processing Unit) or the like. The processor 100 copies or decompresses a program stored in a ROM (Read Only Memory) on the memory 110 and executes various processing by executing the copied or decompressed program.

The memory 110 is, for example, a RAM (Random Access Memory). The memory 110 temporarily stores data used by each functional section of the image forming apparatus 1. The memory 110 may store the digital data generated by the image reading section 10. The memory 110 may temporarily store jobs and job logs.

The auxiliary storage device 120 is, for example, a hard disk or an SSD (Solid State Drive), and stores various kinds of data. The various kinds of data include, for example, digital data, jobs, and job logs.

The network interface 130 is a communication interface. The network interface 130 transmits and receives data to and from another device. Here, another device is an information processing device such as a personal computer, a smartphone, a tablet terminal, or the like. The network interface 130 operates as an input interface to receive data or instructions transmitted from another device. The instruction transmitted from another device may be a printing execution instruction. The network interface 130 operates as an output interface to transmit data to another device.

The counter 140 adds a counted value under the control of the processor 100. For example, a counted value by the counter 140 is added by the number of sheets on which images are formed.

Figure 3:
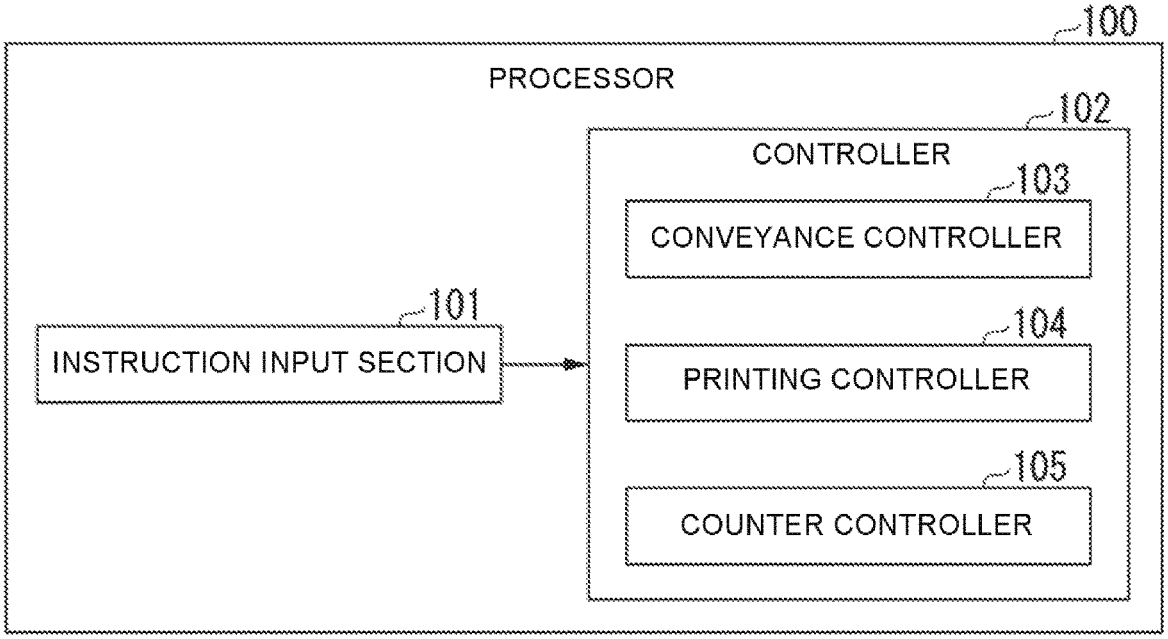
FIG. 3 is a block diagram schematically illustrating functional components of a processor according to the first embodiment.

FIG. 3 is a block diagram schematically illustrating the functional component of the processor 100. The processor 100 includes an instruction input section 101 and a controller 102 by executing programs.

The instruction input section 101 receives an input of a printing execution instruction via the control panel 20 or the network interface 130. The printing execution instruction includes image information and information for designating one or a plurality of copies (hereinafter, referred to as a "number-of-copy designation information").

The controller 102 includes a conveyance controller 103, a printing controller 104 and a counter controller 105.

The conveyance controller 103 controls conveyance of the first sheet and the second sheet by controlling various rollers. Specifically, first, the conveyance controller 103 feeds the first sheet from the first cassette 80A to the conveyance path 50 if an instruction for printing for a plurality of copies is issued. Next, the conveyance controller 103 feeds the second sheet from the second cassette 80B to the conveyance path 50 to insert the second sheet between the respective copies. Then, the conveyance controller 103 repeatedly executes the above processing in the same manner until the printing for all the copies is completed. The conveyance controller 103 does not feed the second sheet after feeding the first sheet used for printing on the final copy.

The printing controller 104 controls the printer section 30 to execute printing based on the image information on the first sheet in response to the printing instruction input via the instruction input section 101.

The counter controller 105 adds the counted value by the counter 140 by the number of the first sheets on which images are formed.

Figure 4:
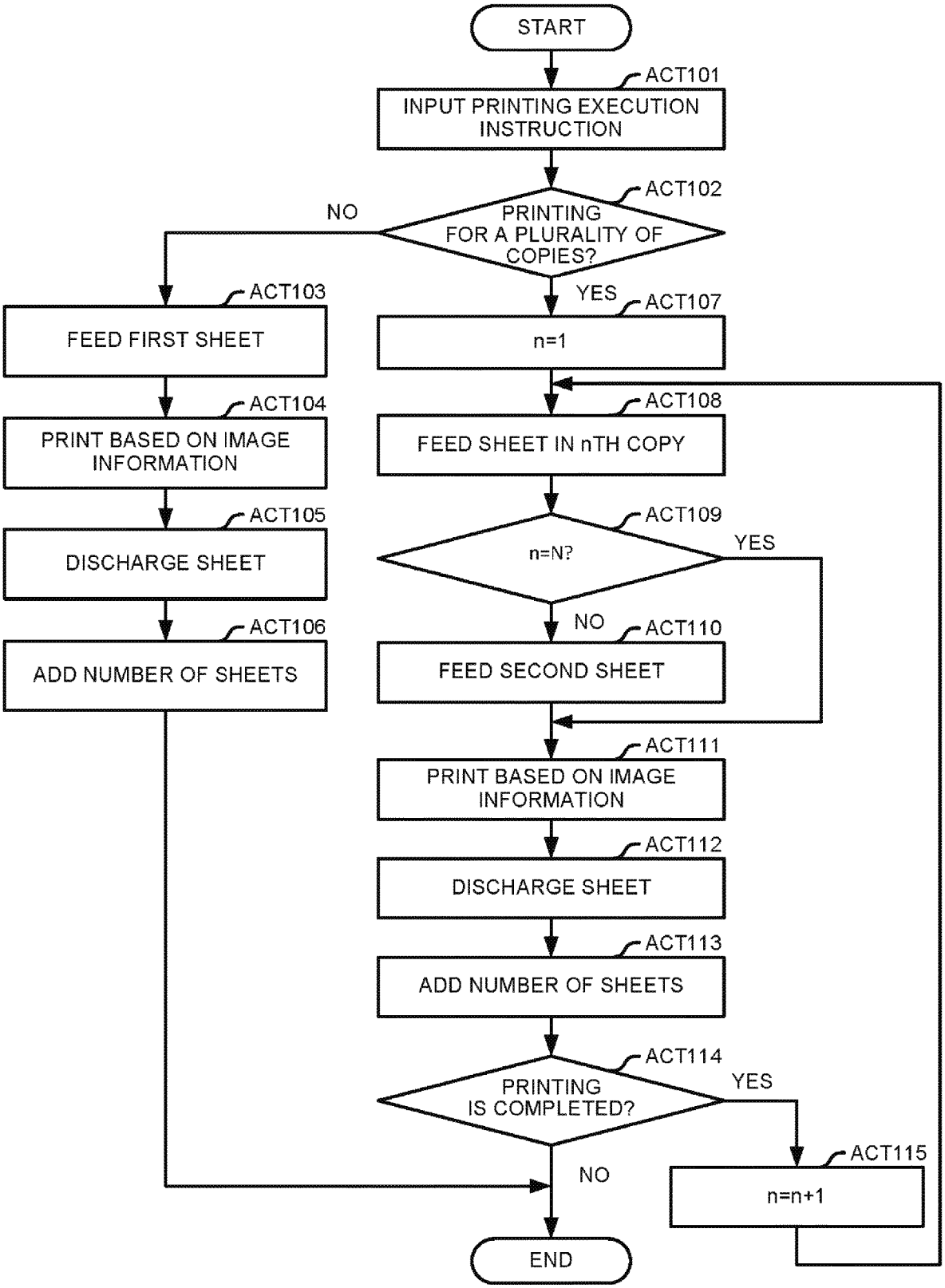
FIG. 4 is a flowchart depicting a flow of a processing of the image forming apparatus according to the first embodiment.

FIG. 4 is a flowchart depicting a flow of a processing of the image forming apparatus 1 according to the first embodiment.

The instruction input section 101 receives an input of a printing execution instruction (ACT 101). Specifically, the instruction input section 101 receives an input of the printing execution instruction via the control panel 20 or the network interface 130. The instruction input section 101 executes processing in ACT 102 if the printing execution instruction is input. Specifically, the instruction input section 101 determines whether or not the printing execution instruction is the printing instruction for a plurality of copies based on the number-of-copy designation information included in the input printing execution instruction (ACT 102).

If the printing execution instruction is not the printing instruction for a plurality of copies (No in ACT 102), the conveyance controller 103 executes the processing in ACT 103. Specifically, the conveyance controller 103 rotates the pickup roller 81A to feed the first sheet from the first cassette 80A to the conveyance path 50 (ACT 103). The conveyance controller 103 may feed the second sheet from the second cassette 80B to the conveyance path 50 when an instruction to designate the second cassette 80B is issued. The printing controller 104 controls the printer section 30 to execute printing based on the image information on the first sheet fed from the first cassette 80A.

The printer section 30 executes printing based on the image information on the first sheet fed from the first cassette 80A (ACT 104). As a result, an image based on the image information is formed on the first sheet. The conveyance controller 103 controls the rollers to discharge the first sheet on which the image is formed to the sheet discharge section 200 (ACT 105). The counter controller 105 adds a value counted by the counter 140 by the number of the first sheets on which images are formed (ACT 106). The information relating to the number of the first sheets may be acquired by a sensor (not shown) provided on the conveyance path 50, or may be acquired by other methods. After that, the image forming apparatus 1 terminates the processing shown in FIG. 4.

In the processing in ACT 102, if the printing execution instruction is a printing instruction for a plurality of copies (Yes in ACT 102), the conveyance controller 103 sets a variable n to 1 (ACT 107). Here, the variable n indicates the number of printing copies. Thereafter, the conveyance controller 103 rotates the pickup roller 81A to feed the first sheet in nth copy from the first cassette 80A to the conveyance path 50 (ACT 108). Specifically, if n is 1, the conveyance controller 103 feeds the first sheets the number of which is equal to the number of sheets required for the printing in the primary copy among the plurality of copies.

The conveyance controller 103 determines whether or not n=N (ACT 109). N represents the number of copies designated by the number-of-copy designation information. If n=N is not satisfied (No in ACT 109), the conveyance controller 103 executes the processing in ACT 110. Specifically, the conveyance controller 103 rotates the pickup roller 81B to feed the second sheet from the second cassette 80B to the conveyance path 50 (ACT 110). For example, the conveyance controller 103 feeds one second sheet from the second cassette 80B to the conveyance path 50. Thereby, after the first sheet in nth copy is fed, the second sheet is fed to the conveyance path 50.

If n=N in ACT 109 (Yes in ACT 109), or after the processing in ACT 110, the printing controller 104 controls the printer section 30. Specifically, the printing controller 104 controls the printer section 30 to execute the printing based on the image information on the first sheet fed from the first cassette 80A. The printer section 30 executes the printing based on the image information on the first sheet fed from the first cassette 80A (ACT 111). As a result, an image based on the image information is formed on the first sheet.

The printing controller 104 controls the printer section 30 not to execute the printing based on the image information on the second sheet. For example, the printing controller 104 does not cause the printer section 30 to form a toner image based on the image information on the second sheet. As a result, even if the intermediate transfer belt 39 contacts the second sheet, the toner image is not transferred onto the second sheet. Therefore, even if the heat and pressure are applied by the fixing device 70, no image based on image information is formed on the second sheet. In other words, the second sheet is blank.

The conveyance controller 103 discharges the first sheet on which an image is formed and the second sheet on which no image is formed to the sheet discharge section 200 (ACT 112). Specifically, the conveyance controller 103 controls the rollers provided between the fixing device 70 and the sheet discharge section 200 to discharge the first sheet and the second sheet to the sheet discharge section 200.

The counter controller 105 adds the counted value by the counter 140 by the number of the first sheets on which images are formed (ACT 113).

The printing controller 104 determines whether or not the printing is completed (ACT 114). Specifically, the printing controller 104 determines that the printing is completed when printing for the Nth copy is completed. On the other hand, the printing controller 104 determines that the printing is not completed when printing for the Nth copy is not completed. If the printing is completed (Yes in ACT 114), the image forming apparatus 1 terminates the processing shown in FIG. 4.

On the other hand, if the printing is not completed (No in ACT 114), the conveyance controller 103 adds 1 to n (ACT 115). Thereafter, the image forming apparatus 1 executes the processing subsequent to ACT 108 in the same manner as described above.

Figure 5:
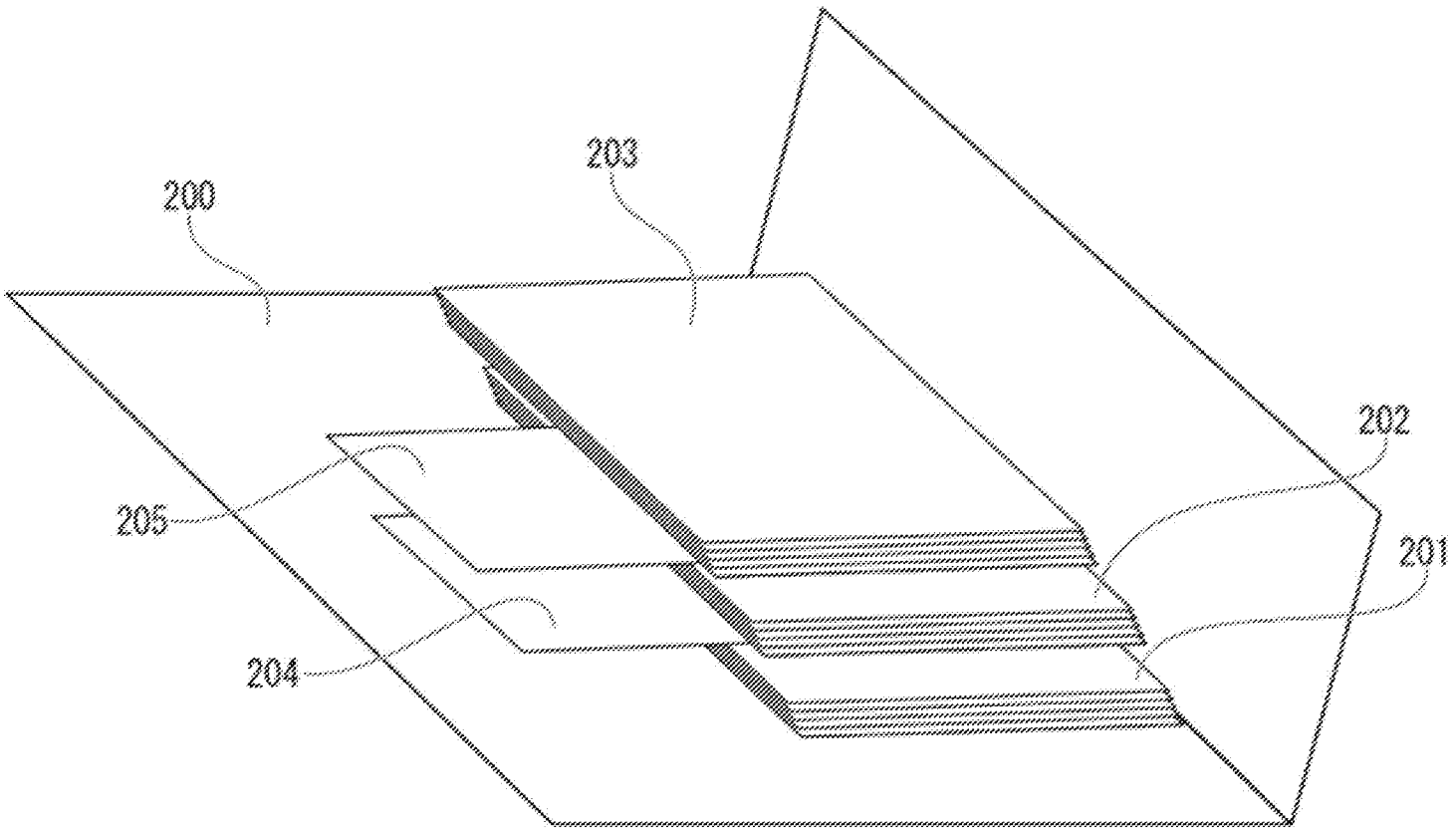
FIG. 5 is a diagram illustrating a printing result of a plurality of copies by the image forming apparatus according to the first embodiment.

FIG. 5 is a diagram illustrating printing result of a plurality of copies by the image forming apparatus 1 according to the first embodiment.

FIG. 5 shows an example in which the number of copies in the printing instruction is 3. In the sheet discharge section 200, first sheets 201, 202 and 203 printed for each copy and second sheets 204 and 205 are inserted between the respective copies. Specifically, the second sheet 204 is inserted between the primary copy including the first sheets 201 and the second copy including the first sheets 202. The second sheet 205 is inserted between the second copy including the first sheets 202 and the third copy including the first sheets 203. The second sheets 204 and 205 are inserted between the copies in different orientations from the first sheets 201, 202 and 203. In this way, the image forming apparatus 1 controls the conveyance of the sheets so that the boundary between respective copies can be visually recognized.

Figure 6:
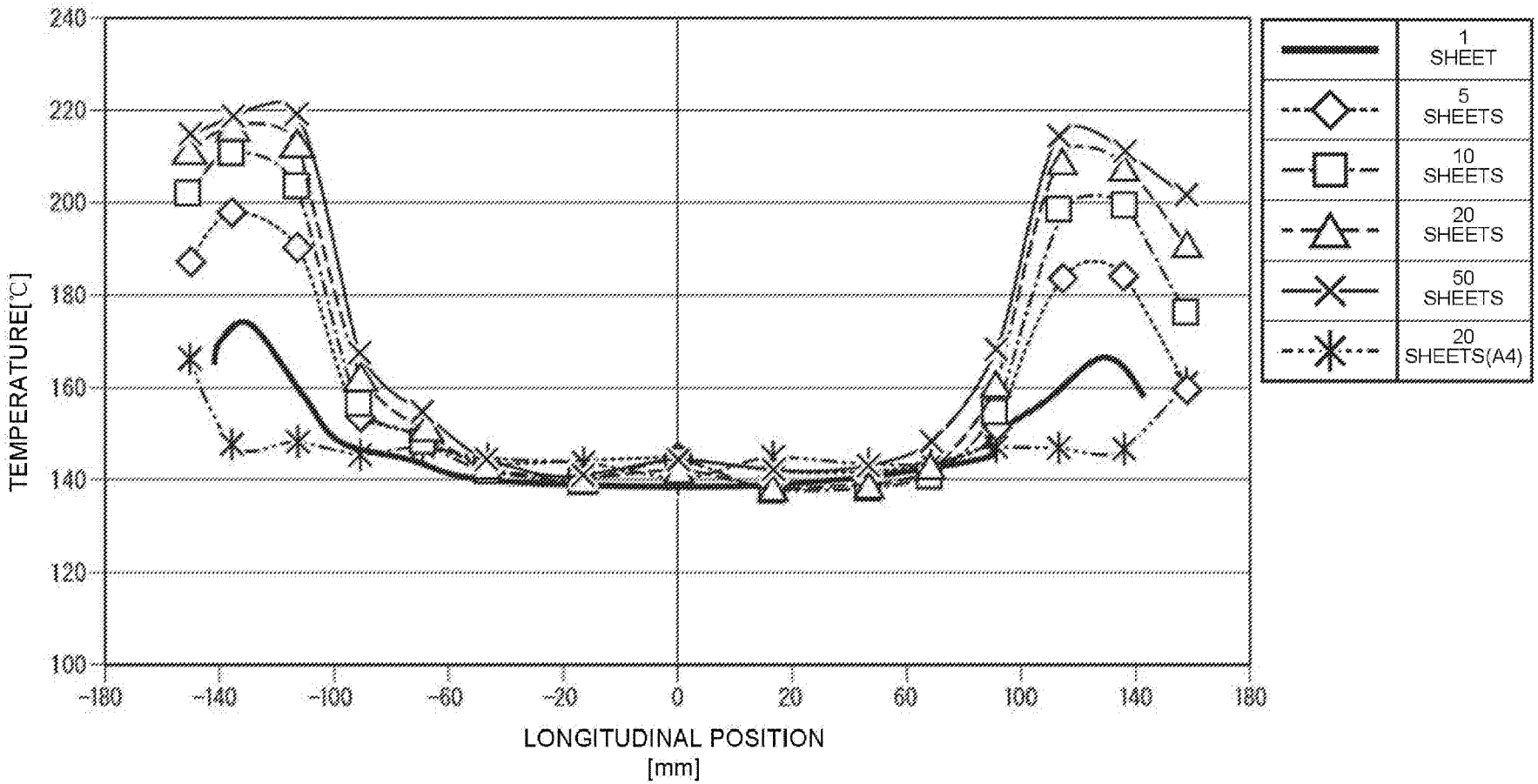
FIG. 6 is a diagram illustrating a temperature distribution of a heating roller included in a fixing device when a sheet is longitudinally fed.

FIG. 6 is a diagram illustrating the temperature distribution of the heating roller of the fixing device 70 when the sheet is longitudinally fed. The temperature distribution shown in FIG. 6 is a distribution when an A4 size sheet is longitudinally fed. In FIG. 6, a horizontal axis indicates a length of the heating roller in the longitudinal direction, and a vertical axis indicates the temperature of the heating roller. The high temperature offset that causes fixing failure occurs at 180 degrees centigrade or more. As shown in FIG. 6, when the printing in which five or more sheets are consecutively longitudinally fed is performed, both ends of the heating roller which are portions where no sheet passes have a temperature of 180 degrees centigrade or more at which the high temperature offset occurs. Therefore, it is shown that the fixing failure tends to occur if the printing in which five or more sheets are consecutively longitudinally fed is performed.

According to the image forming apparatus 1 configured as described above, the high temperature offset can be prevented from occurring. Specifically, the image forming apparatus 1 inserts the second sheet different from the first sheet in the size or the orientation between respective copies if continuous printing such as a printing for a plurality of copies is performed. If the first sheet is longitudinally fed and the second sheet is laterally fed, the second sheet absorbs the heat at the both ends of the heating roller of the fixing device 70. If the first sheet is laterally fed and the second sheet is longitudinally fed, both ends of the heating roller of the fixing device 70 are unlikely to become overheated. As a result, the image forming apparatus 1 can suppress the occurrence of the high temperature offset. As a result, it is possible to eliminate one cause of the fixing failure.

Further, the image forming apparatus 1 does not perform the image formation on the second sheet inserted between the respective copies. Therefore, the second sheet is discharged to the sheet discharge section 200 in a blank state. Therefore, the second sheet can be reused.

Hereinafter, a modification of the image forming apparatus 1 in the first embodiment is described.

The first sheet may be accommodated in the first cassette 80A with a longitudinal direction thereof orthogonal to the sheet conveyance direction from the first cassette 80A to the conveyance path 50 (lateral orientation).

The image forming apparatus 1 in the first embodiment may have three or more cassettes. In this case, for example, the sheet housing section 80 includes the first cassette 80A, the second cassette 80B, and a third cassette 80C. The first cassette 80A accommodates the first sheet. The first sheet is accommodated in the first cassette 80A with a longitudinal direction thereof parallel to the sheet conveyance direction from the first cassette 80A to the conveyance path 50 (longitudinal orientation). The second cassette 80B accommodates the second sheet that is different in the size from the first sheet. The third cassette 80C accommodates a third sheet different in the orientation from the first sheet. The third sheet is accommodated in the third cassette 80C with a longitudinal direction thereof orthogonal to the sheet conveyance direction from the third cassette 80C to the conveyance path 50 (lateral orientation).

Then, in the case of the printing for a plurality of copies, the conveyance controller 103 performs control to insert the second sheet or the third sheet between the respective copies. Specifically, when n is 1, the conveyance controller 103 feeds the first sheets, the number of which is equal to the number of sheets required for the printing in the primary copy among the plurality of copies, to the conveyance path 50. Thereafter, if n=N is not satisfied in the processing in ACT 109, the conveyance controller 103 executes the following processing. Specifically, the conveyance controller 103 feeds the second sheet or the third sheet from the second cassette 80B or the third cassette 80C to the conveyance path 50. Whether the sheet to be fed to the conveyance path 50 is the second sheet or the third sheet may be set in advance or may be set to feed the both sheets alternately.

Second Embodiment

In the second embodiment, the image forming apparatus 1 feeds the second sheet from the second cassette 80B as the primary or final sheet of each copy. Hereinafter, the differences between the image forming apparatus 1 in the second embodiment and that in the first embodiment are described.

In a second embodiment, the second cassette 80B accommodates the second sheet having the same size as the first sheet and different from the first sheet in the orientation. The second sheet is accommodated in the second cassette 80B with a longitudinal direction thereof orthogonal to the sheet conveyance direction from the second cassette 80B to the conveyance path 50 (lateral orientation).

Figure 7:
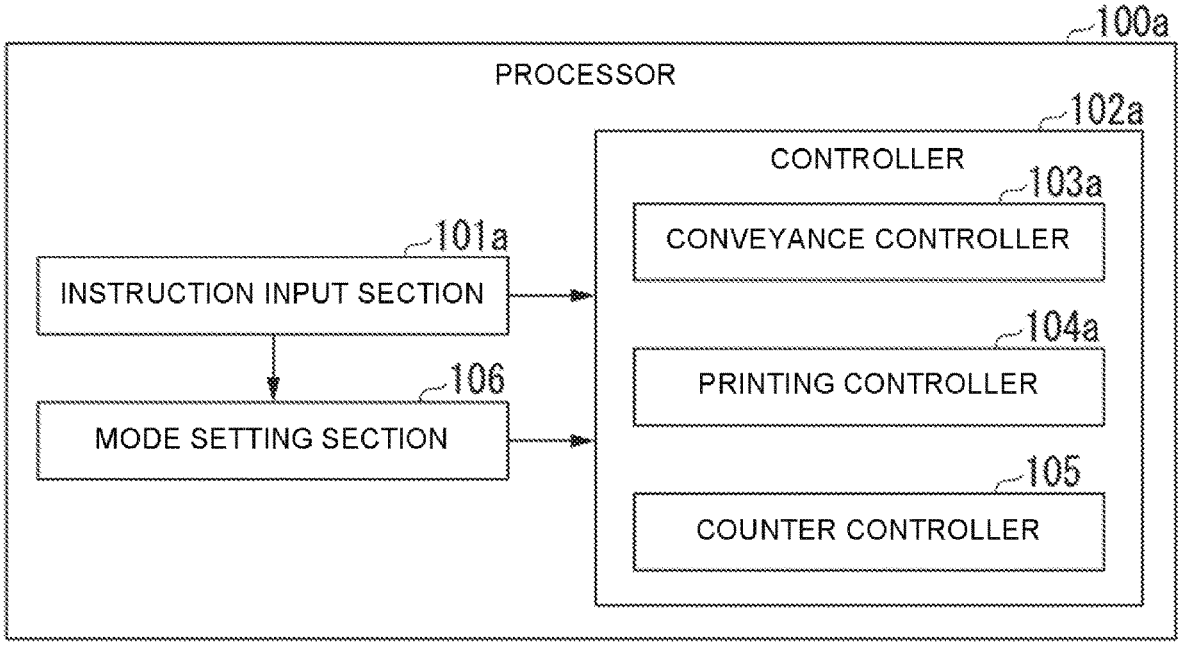
FIG. 7 is a schematic block diagram illustrating functional components of a processor according to a second embodiment.

FIG. 7 is a block diagram schematically illustrating the functional components of a processor 100*a*. By executing the program, the processor 100*a* includes an instruction input section 101*a* and a controller 102*a*. The controller 102*a* includes a conveyance controller 103*a*, a printing controller 104*a*, the counter controller 105 and a mode setting section 106.

The instruction input section 101*a* receives an input of a printing execution instruction via the control panel 20 or the network interface 130. The instruction input section 101*a* receives an input of an instruction for setting a conveyance mode in the image forming apparatus 1 via the control panel 20 or the network interface 130.

The conveyance mode is a mode for designating a conveyance timing of the second sheet in the case where the printing instruction for a plurality of copies is issued. The conveyance mode includes a first conveyance mode and a second conveyance mode. The first conveyance mode is a mode in which the second sheet is conveyed as the primary sheet of each copy. The second conveyance mode is a mode in which the second sheet is conveyed as the final sheet of each copy.

The mode setting section 106 sets the conveyance mode input through the instruction input section 101*a* as the conveyance mode of the image forming apparatus.

The conveyance controller 103*a* controls conveyance of the first sheet and the second sheet by controlling various rollers based on the set conveyance mode.

Next, the operations of the conveyance controller 103*a* in both the first conveyance mode and the second conveyance mode are described.

First, the operation of the conveyance controller 103*a* in the first conveyance mode is described. The conveyance controller 103*a* feeds one second sheet from the second cassette 80B to the conveyance path 50. Then, the conveyance controller 103*a* feeds the first sheet from the first cassette 80A to the conveyance path 50. At this time, the conveyance controller 103*a* feeds the first sheets, the number of which is 1 less than the number of sheets required for the printing in one copy, from the first cassette 80A to the conveyance path 50. Then, the conveyance controller 103 repeatedly executes the above processing until printing for all copies is completed.

Next, the operation of the conveyance controller 103*a* in the second conveyance mode is described. The conveyance controller 103*a* feeds the first sheet from the first cassette 80A to the conveyance path 50. At this time, the conveyance controller 103*a* feeds the first sheets, the number of which is 1 less than the number of sheets required for the printing in one copy, from the first cassette 80A to the conveyance path 50. Next, the conveyance controller 103*a* feeds one second sheet from the second cassette 80B to the conveyance path 50. Then, the conveyance controller 103*a* repeatedly executes the above processing until the printing for all copies is completed.

The conveyance controller 103*a* performs the above-described control to feed the second sheet from the second cassette 80B as the primary sheet or the final sheet of each copy. In the following description, the second conveyance mode is set as the conveyance mode is described as an example.

The printing controller 104*a* controls the printer section 30 to execute the printing based on the image information on the first sheet and the second sheet in response to the printing instruction input through the instruction input section 101*a*.

Figure 8:
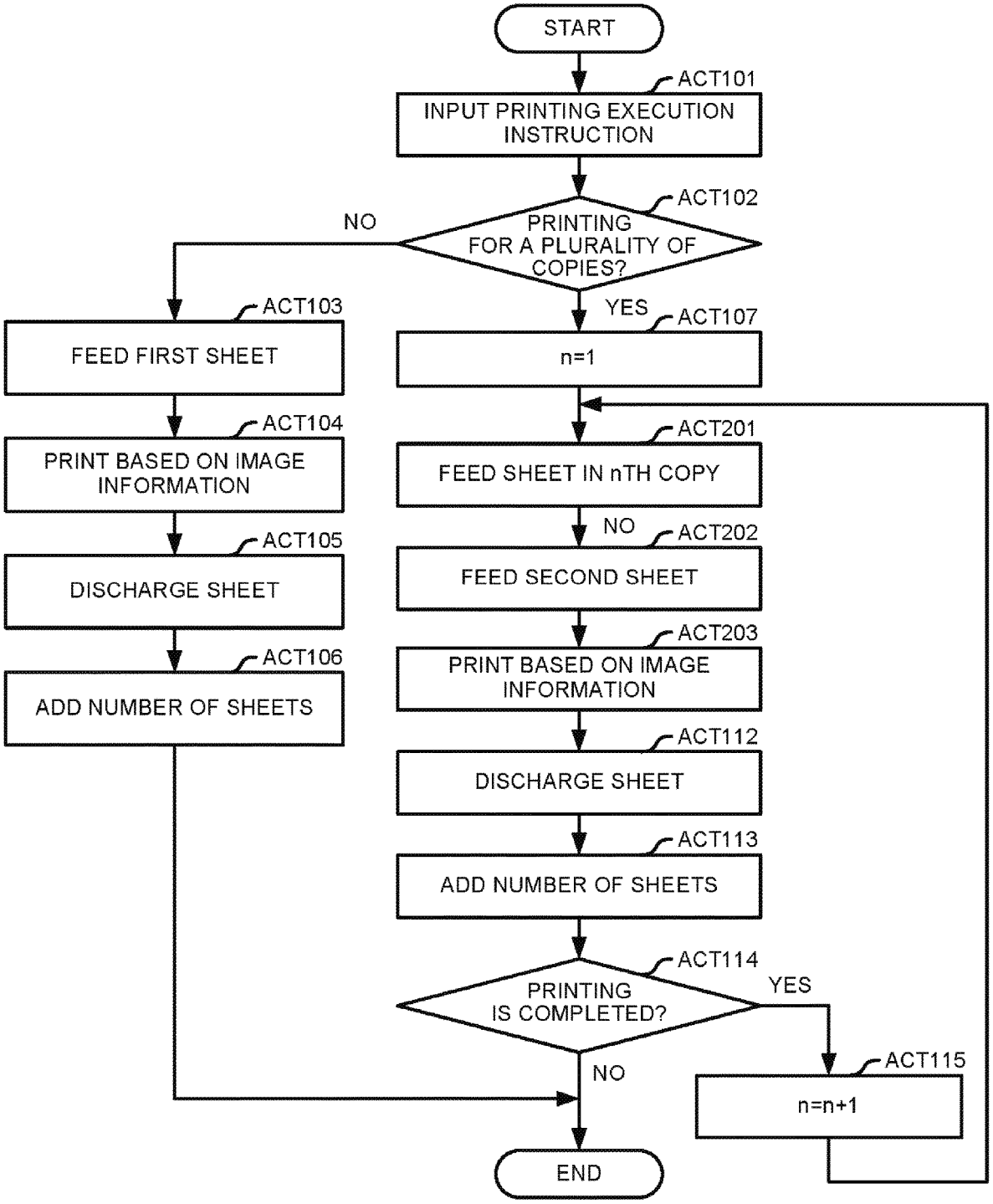
FIG. 8 is a flowchart depicting a flow of a processing of an image forming apparatus according to the second embodiment.

FIG. 8 is a flowchart depicting a flow of a processing of the image forming apparatus 1 according to the second embodiment. The processing in FIG. 8 that is the same as that in FIG. 4 is denoted with the same reference numerals, and the description thereof is omitted.

After the processing in ACT 107, the conveyance controller 103*a* performs the processing in ACT 201. The conveyance controller 103*a* rotates the pickup roller 81A to feed the first sheet in the nth copy from the first cassette 80A to the conveyance path 50 (ACT 201). Specifically, when n is 1, the conveyance controller 103*a* feeds the first sheets, the number of which is 1 less than the number of sheets required for printing in the primary copy among a plurality of copies, to the conveyance path 50.

Next, the conveyance controller 103*a* rotates the pickup roller 81B to feed one second sheet from the second cassette 80B to the conveyance path 50 (ACT 202). Thereby, after the first sheets in the nth copy are conveyed, the second sheet is fed to the conveyance path 50.

The printing controller 104*a* controls the printer section 30 to execute printing based on the image information on the fed first sheet and second sheet, respectively. The printer section 30 executes printing based on the image information on the first sheet and the second sheet (ACT 203). More specifically, first, the printer section 30 executes the printing based on the image information on the first sheets, the number of which is 1 less than the number of sheets required for printing in the primary copy among a plurality of copies. Next, the printer section 30 executes the printing based on the image information on one second sheet. As a result, images based on the image information are formed on the first sheet and the second sheet. After that, the processing subsequent to ACT 112 is executed in the same manner as described above.

The processing by the printer section 30 when the first conveyance mode is set as the conveyance mode is performed as follows. First, the printer section 30 executes the printing based on the image information on one second sheet. Next, the printer section 30 executes the printing based on the image information on the first sheets, the number of which is 1 less than the number of sheets required for printing in one copy.

In other words, in the first conveyance mode, when the printing is performed based on the image information on a plurality of sheets in one copy, the following processing is performed. The printer section 30 prints an image to be printed on a primary sheet on the second sheet fed from the second cassette 80B. The printer section 30 prints remaining images to be printed on second and subsequent sheets on the first sheets fed from the first cassette 80A.

Similarly, in the second conveyance mode, when the printing is performed based on the image information on a plurality of sheets in one copy, the following processing is performed. The printer section 30 prints an image to be printed on a final sheet on the second sheet fed from the second cassette 80B. The printer section 30 prints the remaining images (excluding the image to be printed on the final sheet) including an image to be printed on the primary sheet on the first sheets fed from the first cassette 80A.

The image forming apparatus 1 in the second embodiment configured as described above conveys the sheets in such a manner that the second sheet different from the first sheet in the orientation is conveyed as the primary or the final sheet of each copy. The image forming apparatus 1 also performs printing on the second sheet based on the image information. Thus, there is no need to insert a blank second sheet between respective copies as in the first embodiment. As a result, there is no need for the user to return the blank sheet to the second cassette 80B. Therefore, it is possible to physically recognize the boundary of each copy and to reduce the load on the user.

Hereinafter, a modification of the image forming apparatus 1 according to the second embodiment is described.

The conveyance controller 103*a* may feed a predetermined number of second sheets including the primary sheet in each copy or a predetermined number of second sheets including the final sheet in each copy from the second cassette 80B. The operation of the printer section 30 configured as described above is described as follows.

First, the case in which the first conveyance mode is set as the conveyance mode is described. The printer section 30 forms images on a predetermined number of second sheets including the primary sheet among the total number of sheets required for the printing in one copy. Thereafter, the printer section 30 forms images on the first sheets, the number of which is obtained by subtracting the above predetermined number of sheets from the total number of sheets required for the printing in one copy.

Next, the case in which the second conveyance mode is set as the conveyance mode is described. The printer section 30 forms images on the first sheets, the number of which is obtained by subtracting a predetermined number of sheets from the total number of sheets required for the printing in one copy. Thereafter, the printer section 30 forms images on the above predetermined number of second sheets including the final sheet among the total number of sheets required for the printing in one copy.

In the second embodiment, the second cassette 80B may accommodate the second sheet different from the first sheet in at least one of the size and the orientation, as in the first embodiment.

The image forming apparatus 1 in the second embodiment may have three or more cassettes. In this case, for example, the sheet housing section 80 includes the first cassette 80A, the second cassette 80B, and a third cassette 80C. The first cassette 80A accommodates the first sheet. The first sheet is accommodated in the first cassette 80A with a longitudinal direction thereof parallel to the sheet conveyance direction (longitudinal orientation). The second cassette 80B accommodates the second sheet that is different only in the orientation from the first sheet. The third cassette 80C accommodates a third sheet different only in the size from the first sheet. Then, in the case of printing for a plurality of copies, the conveyance controller 103*a* performs control to feed either the second sheet or the third sheet as the primary sheet or the final sheet of each copy.

Modifications common to the first embodiment and the second embodiment are described.

In the fixing device 70 of each of the above embodiments, a system of fixing the toner image on the sheet by heating it with a film-like member may be applied.

A part of the functions of the image forming apparatus 1 according to the foregoing embodiments may be realized by a computer. In this case, programs for realizing the functions are recorded in a computer-readable recording medium. The functions may be realized by reading programs recorded in the computer-readable recording medium into a computer system and executing them.

Further, it is assumed that the "computer system" described herein contains an operating system or hardware such as peripheral devices. The "computer-readable recording medium" refers to a portable medium, a storage device or the like. The portable medium is a flexible disc, a magneto-optical disk, a ROM, a CD-ROM and the like. The storage device is a hard disk built in the computer system. Furthermore, the "computer-readable recording medium" refers to a medium for dynamically holding the programs for a short time like a communication wire in a case in which the programs are transmitted via a communication line. The communication line is a network such as the Internet or a telephone line. The "computer-readable recording medium" may be a volatile memory in the computer system serving as a server and a client. The volatile memory holds the programs for a certain time. The foregoing programs may realize a part of the above-mentioned functions. Further, the above functions may be realized by combining the foregoing programs with the programs already recorded in the computer system.

While certain embodiments have been described these embodiments have been presented by way of example only, and are not intended to limit the scope of the inventions.

Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

a first cassette configured to accommodate a first sheet;

a second cassette configured to accommodate a second sheet different from the first sheet in at least one of a size and an orientation;

a controller configured to control feeding the first sheet to a conveyance path from the first cassette and control feeding the second sheet to the conveyance path from the second cassette to insert the second sheet between respective copies if a printing instruction for a plurality of copies is issued;

a sheet discharge section configured to stack the first sheet and the second sheet;

an image forming section configured to form an image on the first sheet and the second sheet; and a mode setting section configured to set a mode for designating a conveyance timing of the second sheet, wherein the second sheet having the same size as the first sheet is accommodated in the second cassette in an orientation different from that of the first sheet, the mode setting section sets either a first conveyance mode in which the second sheet is conveyed as at least a primary sheet of each copy, or a second conveyance mode in which the second sheet is conveyed as at least a final sheet of each copy, the controller controls conveyance of the first sheet and the second sheet in either the first conveyance mode or the second conveyance mode set by the mode setting section, and the image forming section forms images on the conveyed first sheet and second sheet.

2. The image forming apparatus according to claim 1, further comprising:

an image forming section configured to form an image on the first sheet, with the proviso that the image forming section does not form an image on the second sheet.

3. The image forming apparatus according to claim 1, wherein the first cassette comprises a first roller for feeding the first sheet to the conveyance path, the second cassette comprises a second roller for feeding the second sheet to the conveyance path, and the controller rotates the first roller to feed the first sheets, the number of which is equal to the number of sheets required for printing in one copy, from the first cassette to the conveyance path, and then rotates the second roller to feed the second sheet from the second cassette to the conveyance path.

4. The image forming apparatus according to claim 3, wherein the controller feeds the second sheet from the second cassette to the conveyance path, and then rotates the first roller to feed the first sheets, the number of which is equal to the number of sheets required for printing in one copy, from the first cassette to the conveyance path.

5. The image forming apparatus according to claim 1, wherein when the first conveyance mode is set by the mode setting section, the controller feeds a first quantity of second sheets from the second cassette to the conveyance path, and then feeds the first sheets, the number of which is obtained by subtracting the first quantity from a total number of sheets required for printing in one copy, from the first cassette to the conveyance path, and the image forming section forms images on the first quantity of second sheets, and then forms images on the first sheets the number of which is obtained by subtracting the first quantity.

6. The image forming apparatus according to claim 1, wherein when the second conveyance mode is set by the mode setting section, the controller feeds the first sheets, the number of which is obtained by subtracting a second quantity from a total number of sheets required for printing in one copy, from the first cassette to the conveyance path, and then feeds the second quantity of second sheets from the second cassette to the conveyance path, and the image forming section forms images on the first sheets the number of which is obtained by subtracting the second quantity, and then forms images on the second quantity of second sheets.

7. The image forming apparatus according to claim 1, further comprising:

a printer comprising toner comprising a non-decolorable recording agent.

8. The image forming apparatus according to claim 7, wherein the toner has a glass transition temperature of 50 degrees centigrade or lower.

9. The image forming apparatus according to claim 1, wherein the second sheet has a size larger than a size of the first sheet.

10. A sheet conveyance method by an image forming apparatus, comprising:

controlling feeding a first sheet to a conveyance path from a first cassette for accommodating the first sheet;

controlling feeding a second sheet, which is different from the first sheet in at least one of a size and an orientation, to the conveyance path from a second cassette for accommodating the second sheet to insert the second sheet between respective copies if a printing instruction for a plurality of copies is issued;

discharging the first sheet and the second sheet to a sheet discharge section;

forming an image on the first sheet and the second sheet; and setting a mode for designating a conveyance timing of the second sheet, wherein the second sheet having the same size as the first sheet is accommodated in the second cassette in an orientation different from that of the first sheet, setting either a first conveyance mode in which the second sheet is conveyed as at least a primary sheet of each copy, or a second conveyance mode in which the second sheet is conveyed as at least a final sheet of each copy, controlling conveyance of the first sheet and the second sheet in either the first conveyance mode or the second conveyance mode set by the mode setting section, and forming images on the conveyed first sheet and second sheet.

11. The sheet conveyance method according to claim 10, further comprising:

forming an image on the first sheet, with the proviso that an image is not formed on the second sheet.

12. The sheet conveyance method according to claim 10, further comprising:

feeding the first sheet to the conveyance path using a first roller, feeding the second sheet to the conveyance path using a second roller, and rotating the first roller to feed the first sheets, the number of which is equal to the number of sheets required for printing in one copy, from the first cassette to the conveyance path, and then rotating the second roller to feed the second sheet from the second cassette to the conveyance path.

13. The sheet conveyance method according to claim 12, further comprising:

feeding the second sheet from the second cassette to the conveyance path, and then rotating the first roller to feed the first sheets, the number of which is equal to the number of sheets required for printing in one copy, from the first cassette to the conveyance path.

14. The sheet conveyance method according to claim 10, wherein when the first conveyance mode is set, feeding a first quantity of second sheets from the second cassette to the conveyance path, and then feeding the first sheets, the number of which is obtained by subtracting the first quantity from a total number of sheets required for printing in one copy, from the first cassette to the conveyance path, and forming images on the first quantity of second sheets, and then forming images on the first sheets the number of which is obtained by subtracting the first quantity.

15. The sheet conveyance method according to claim 10, wherein when the second conveyance mode is set, feeding the first sheets, the number of which is obtained by subtracting a second quantity from a total number of sheets required for printing in one copy, from the first cassette to the conveyance path, and then feeding the second quantity of second sheets from the second cassette to the conveyance path, and forming images on the first sheets the number of which is obtained by subtracting the second quantity, and then forming images on the second quantity of second sheets.

16. The sheet conveyance method according to claim 10, further comprising:

printing with a toner comprising a non-decolorable recording agent.

17. The sheet conveyance method according to claim 16, wherein the toner has a glass transition temperature of 50 degrees centigrade or lower.

18. The sheet conveyance method according to claim 10, wherein the second sheet has a size larger than a size of the first sheet.

* * * * *